US007478475B2

(12) United States Patent
Hall

(10) Patent No.: US 7,478,475 B2
(45) Date of Patent: Jan. 20, 2009

(54) METHOD OF ASSEMBLING COAXIAL CONNECTOR

(75) Inventor: Richard D. Hall, Chandler, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 185 days.

(21) Appl. No.: 11/489,070

(22) Filed: Jul. 19, 2006

(65) Prior Publication Data

US 2006/0258209 A1 Nov. 16, 2006

Related U.S. Application Data

(63) Continuation of application No. 10/867,848, filed on Jun. 14, 2004, now Pat. No. 7,128,604.

(51) Int. Cl.
*H01R 43/00* (2006.01)
*H01R 9/05* (2006.01)

(52) U.S. Cl. ..... 29/869; 29/828; 29/867; 29/870; 439/578; 439/584; 439/585

(58) Field of Classification Search ..... 29/825, 29/828, 868–870; 439/578, 584–585
See application file for complete search history.

(56) References Cited

U.S. PATENT DOCUMENTS

| | | | | |
|---|---|---|---|---|
| 2,879,977 A | | 3/1959 | Trought | 165/80.3 |
| 3,002,166 A | | 9/1961 | Weinshcel | 333/81 A |
| 3,161,453 A | * | 12/1964 | Powell | 439/578 |
| 3,280,907 A | | 10/1966 | Hoffman | 165/185 |
| 3,343,122 A | * | 9/1967 | Drogo | 439/584 |
| 3,439,294 A | * | 4/1969 | Flanagan et al. | 333/33 |
| 3,484,660 A | | 12/1969 | Rosser | 317/237 |
| 3,596,100 A | | 7/1971 | Hollick | 73/862.324 |
| 3,757,278 A | * | 9/1973 | Schumacher | 439/585 |
| 4,053,200 A | * | 10/1977 | Pugner | 439/578 |
| 4,227,765 A | * | 10/1980 | Neumann et al. | 439/248 |

(Continued)

FOREIGN PATENT DOCUMENTS

| | | |
|---|---|---|
| GB | 2006548 | 5/1979 |
| GB | 2057198 | 3/1981 |

OTHER PUBLICATIONS

2002 Microwave Products Catalog, Corning Discovering Beyond Imagination, GPO™ push-on, Corning Gilbert, G-1500-102 Feb. 2002.

(Continued)

*Primary Examiner*—C. J Arbes
(74) *Attorney, Agent, or Firm*—Joseph M. Homa; Matthew J. Mason

(57) ABSTRACT

A blindmate interconnect coaxial connector includes a center conductor, a thermally-conductive dielectric surrounding the center conductor, and an outer tubular conductor surrounding the dielectric. The dielectric transfers heat from the center conductor to the outer conductor, and the outer conductor includes heat transfer fins to radiate such heat. The center conductor is formed by first and second halves which mate within the axial bore of the dielectric. The outer conductor is formed of two mating sections. The center conductor and surrounding dielectric are inserted within the first mating section, and the second mating section is then mated with the first section to complete the assembly of the connector.

11 Claims, 3 Drawing Sheets

U.S. PATENT DOCUMENTS

| | | | | |
|---|---|---|---|---|
| 4,596,435 | A * | 6/1986 | Bickford | 439/582 |
| 5,060,716 | A | 10/1991 | Heine | 165/47 |
| 5,067,912 | A * | 11/1991 | Bickford et al. | 439/578 |
| 5,217,392 | A * | 6/1993 | Hosler, Sr. | 439/585 |
| 5,740,772 | A | 4/1998 | Bluma | 123/196 AB |
| 6,733,324 | B1 * | 5/2004 | Lecsek et al. | 439/485 |
| 6,778,944 | B2 * | 8/2004 | Kaneyama et al. | 702/183 |

OTHER PUBLICATIONS

Tri-Star Plastics Web page regarding "Fluoropolymers (PTFE)—Fluoroloy H," published on or before Jan. 14, 2001.

Thermal conductivity of PTFE and PTFE composites, Thermochimica Acta 392-393 (2002) 229-234, Duncan M. Price, Mark Jarratt, IPTME, Loughborough University, Loughborough, Leics. LE11 3TU, UK, Department of Physics, University of Warwick, Coventry CV4 7AI, UK.

Declaration of Eric J. Paulus dated Sep. 23, 2005 consisting of 2 pages.

Redacted Drawing No. OL-SK1299-BMI of Gilbert Engineering Co., Inc., drawn by "MJC" on Nov. 13, 1997.

Redacted Drawing No. SK-1299-BMI of Gilbert Engineering Co., Inc. drawn by "MJC" on Jun. 15, 1998.

* cited by examiner

METHOD OF ASSEMBLING COAXIAL CONNECTOR

This is a continuation of U.S. patent application Ser. No. 10/867,848 filed on Jun. 14, 2004, now U.S. Pat. No. 7,128,604 the content of which is relied upon and incorporated herein by reference in its entirety, and the benefit of priority under 35 U.S.C. § 120 is hereby claimed.

BACKGROUND OF THE INVENTION

1. Field of the Invention

The present invention relates generally to coaxial electrical connectors used to transmit microwave radio frequency electrical signals, and more particularly, to microwave coaxial connectors capable of handling relatively higher-power microwave signals.

2. Description of the Relevant Art

Coaxial connectors used to transmit radio frequency signals for broadband telecommunications, military avionics, and microwave systems are well known in the art. Such connectors are often known as "SMP" connectors, or "SMPM" connectors, and are constructed in accordance with military standard MILSTD 348. For example, for many years, Gilbert Engineering Co., Inc. of Glendale, Ariz., now Corning Gilbert Inc., has made available microwave coaxial connectors sold under the trademarks "GPO" and "GPPO" to facilitate so-called "push-on" interconnects in microwave applications. Such connectors are typically designed to handle signals in the frequency range from approximately 2 GHz up to as much as 40 GHz.

One common type of such coaxial connectors is referred to as a "blindmate interconnect", or "bullet", having two opposing female ports at its opposing ends. Such a bullet is often inserted between two panel or circuit mounted male ports, also known as "shrouds", for connecting two modules together; a blindmate interconnect, or bullet, accommodates increased misalignment between two adjacent panel modules while achieving reliable interconnection between the respective ports on such panel modules. Such connectors are relatively small in size, typically measuring less than 10.2 mm (0.40 inch) in length, and only approximately 3.3 mm (0.13 inch) in diameter, to allow for high packing densities. These blindmate interconnects include a center metallic conductor, an outer tubular metallic conductor, and an electrically-insulative dielectric interposed between the center conductor and the outer tubular conductor. The ends of the center metallic conductor are typically formed into resilient, spring-like slotted fingers for gripping a received center conductor of a mating male port. While such slotted fingers are usually plated with gold to reduce contact resistance, there is always some finite amount of contact resistance (typically, about 6 milliohms) at the point at which such slotted fingers grip the center conductor of the mating male port.

In view of their relatively small physical size, such commercially available microwave coaxial connectors necessarily impose limitations in power level of radio frequency signals that can be transmitted by such connectors. Moreover, power level limitations impose corresponding limitations upon the distances over which such RF signals can be transmitted. The power loss of a given RF signal within a connector is a function of the frequency; the higher the frequency, the higher the power loss. In view of the finite contact resistance mentioned above at the point at which the slotted fingers grip the center contact of the male ports mated therewith, a fraction of the power in the radio frequency signal that is transmitted by such coaxial connectors is converted to heat, thereby raising the temperature of the center conductor within such coaxial connectors. The power handling capability of such known coaxial connectors is determined by the cross-sectional size of the center conductor and the amount of contact resistance. Increasing the diameter of the center conductor can increase power handling capability, but the overall size of the connector would also increase, and packing density would decrease. As power increases, temperature rises, and eventually the relatively-small coaxial connector is unable to reliably handle such higher temperatures. In particular, such elevated temperatures cause the dielectric to deteriorate, thereby causing an increase in electrical mismatch, which in turn, causes more power to be reflected back through the connector. Elevated temperatures also degrade and oxidize the spring metal core of the slotted fingers of the center conductor.

Common PTFE (polytetraflouroethylene), also known under the brand name TEFLON®, is the dielectric material ordinarily used within such blindmate interconnects. U.S. Pat. No. 5,067,912 to Bickford, et al. discloses the use of PTFE as an insulator within a microwave connector. Common PTFE is relatively pliable and can be temporarily compressed without being damaged. This property of PTFE is often used to advantage by manufacturers of coaxial connectors during the assembly process; such common PTFE insulators can be press-fit over center conductors and/or press-fit into tubular outer conductors during assembly without causing damage to such insulator. Nonetheless, common PTFE is a relatively poor conductor of heat; it has a thermal conductivity of only 0.25 W/(m-° K) (1.7 BTU-in/(hr.-ft.$^2$-° F.)). As a result, heat added to the center conductor of a conventional blindmate interconnect is not easily dissipated. In addition, common PTFE has a relatively high coefficient of thermal expansion (CTE) value. Accordingly, heat transferred by the center conductor to the surrounding dielectric causes a change in the physical dimensions of the PTFE dielectric. This induced change in physical dimensions of the dielectric again causes electrical mismatch, increased power reflection back through the connector, and even greater heating within the connector.

Accordingly, it is an object of the present invention to provide a coaxial connector for microwave applications wherein the power level of radio frequency signals that can be reliably passed through such connector is significantly increased.

It is a another object of the present invention to provide such a coaxial connector which allows for greater transmission distances by facilitating the transmission of RF signals having greater power levels.

It is still another object of the present invention to provide such a coaxial connector which handles greater power levels without significantly lessening the packing density of such connectors.

It is a still further object of the present invention to provide such a coaxial connector which can be assembled in a relatively simple manner without damaging the dielectric insulator.

Still another object of the present invention is to provide such a coaxial connector wherein the center conductor is reliably captured within the dielectric insulator, and wherein the dielectric insulator is reliably captured within the tubular outer conductor body.

These and other objects of the invention will become more apparent to those skilled in the art as the description of the present invention proceeds.

SUMMARY OF THE INVENTION

Briefly described, and in accordance with a preferred embodiment thereof, the present invention relates to a coaxial connector first and second opposing ends, and including a center conductor, a dielectric substantially surrounding the outer surface of said center conductor, and a generally tubular outer conductor substantially surrounding the dielectric, wherein the dielectric has a thermal conductivity of at least about 0.75 W/(m-° K) (5 BTU-in/(hr.-ft.$^2$-° F.)). The first end of the center conductor, and the first end of the outer conductor, collectively form the first end of the coaxial connector for receiving a first mating coaxial member. Likewise, the second end of the center conductor, and the second end of the outer conductor, collectively form the a second end of the coaxial connector for receiving a second mating coaxial member. Preferably, the first and second ends of such coaxial connector are adapted to mate with an SMP connector, or an SMPM connector, of the type described in MILSTD 348. In a preferred embodiment, the coaxial connector is a blind interconnect, or bullet, with a female socket provided at each end thereof.

The dielectric is preferably formed from a reinforced fluoropolymer material, such as Fluoroloy H®, to take advantage of its relatively high thermal conductivity, and relatively low coefficient of thermal expansion. The dielectric is in thermal contact with the outer conductor, particularly in the central portions of the dielectric and outer conductor. Preferably, the outer conductor includes cooling fins along its central region to facilitate the transfer of heat away from the connector.

Because Fluoroloy H® material is relatively brittle, the connector is assembled in a manner that avoids undue mechanical stresses on such material. In this regard, the outer conductor is preferably divided into first and second mating sections, the first section providing the first end of the outer conductor, and the second section providing the second end of the outer conductor. The two sections of the outer conductor can be inserted over the dielectric to capture the dielectric inside the outer conductor without exerting undue compression of the dielectric during assembly.

Similarly, it is preferred that the center conductor be formed by first and second halves that extend along a common axis, and which are mechanically and electrically coupled to each other inside the dielectric. The first half of the center conductor extends largely within the first section of the outer conductor, and the second half of the center conductor extends largely within the second section of the outer conductor. In the preferred embodiment, the first and second halves of the center conductor include female sockets disposed at the opposing ends of the coaxial connector for receiving male pins of first and second mating coaxial members, respectively. The first and second halves also preferably include mating coupling members for joining the first and second halves to each other within the central region of the dielectric. The female sockets formed on the center conductor halves preferably include a plurality of slotted fingers which are adapted to open outwardly to receive a male pin of a matting coaxial device. To further reduce contact resistance, each of the female sockets includes at least four such slotted fingers.

Generally, the outer diameters of the female sockets of the center conductor halves are of greater diameter than the outer diameters of the central portions of such center conductor halves. The dielectric has an inner axial bore extending therethrough for receiving the first and second halves of the center conductor. The central region of the inner axial bore has an internal diameter commensurate with the outer diameters of the central portions of the center conductor halves for placing the central region of the dielectric in thermal contact with at least one, and preferably both, of the central portions of the center conductor halves. On the other hand, the opposing end regions of the inner axial bore of the dielectric have a larger internal diameter to accommodate the larger outer diameter of the female sockets of the center conductor halves.

In order to capture the dielectric within the outer conductor, the outer conductor preferably has an annular recess formed within its inner surface. The dielectric has a corresponding enlarged outer diameter ring formed upon its outer surface adapted to extend within the annular recess of the outer conductor, thereby restraining the dielectric against axial movement within the outer conductor.

Another aspect of the present invention relates to a method of assembling such a coaxial connector. In practicing such method, the center conductor is provided as first and second mating halves, each including a female socket for receiving a male pin of a mating member. The dielectric is provided with an axial bore extending therethrough between its first and second opposing ends. The first half of the center conductor is inserted within the first end of the axial bore of the dielectric, and then the second half of the center conductor is inserted within the second end of the axial bore of the dielectric, while coupling the first and second halves of the center conductor together to extend along a common axis. This assembly is inserted into the hollow tubular outer conductor, with at least a portion of the dielectric in intimate physical and thermal contact with the outer conductor.

As mentioned above, the outer conductor is preferably provided as first and second mating sections, and the step of inserting the dielectric into the outer conductor is accomplished by first inserting one end of the dielectric within the first section of the outer conductor, and then engaging the second section of the outer conductor over the other end of the dielectric to join the two outer conductor sections to each other around the dielectric. The novel method also preferably includes the formation of an annular recess on the inner surface of the outer conductor, providing an enlarged outer diameter on an outer surface of the dielectric, and inserting the enlarged outer diameter of the dielectric within such annular recess to restrain the dielectric from axial movement within the outer conductor.

DETAILED DESCRIPTION OF THE PREFERRED EMBODIMENT

Figure 1:
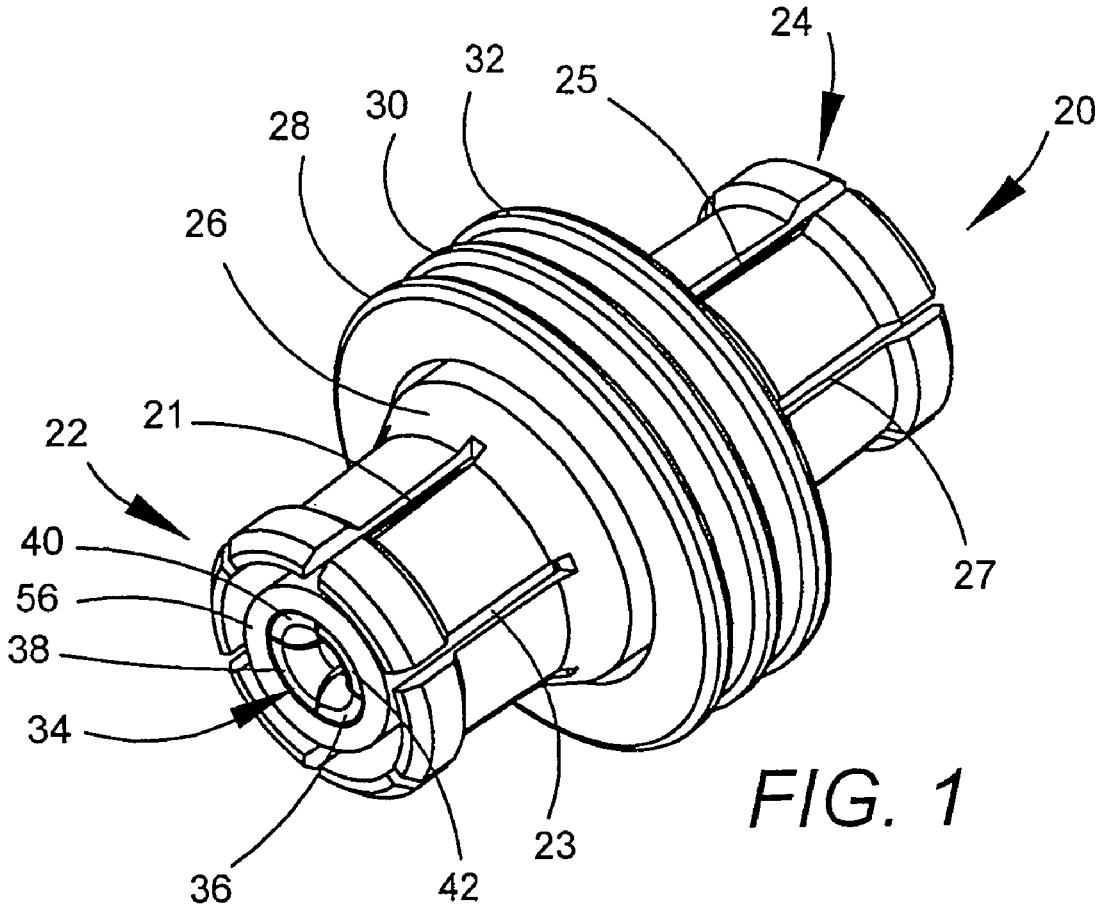
FIG. 1 is a perspective view of a blind interface coaxial connector for microwave applications constructed in accordance with the teachings of the present invention.
Figure 2:
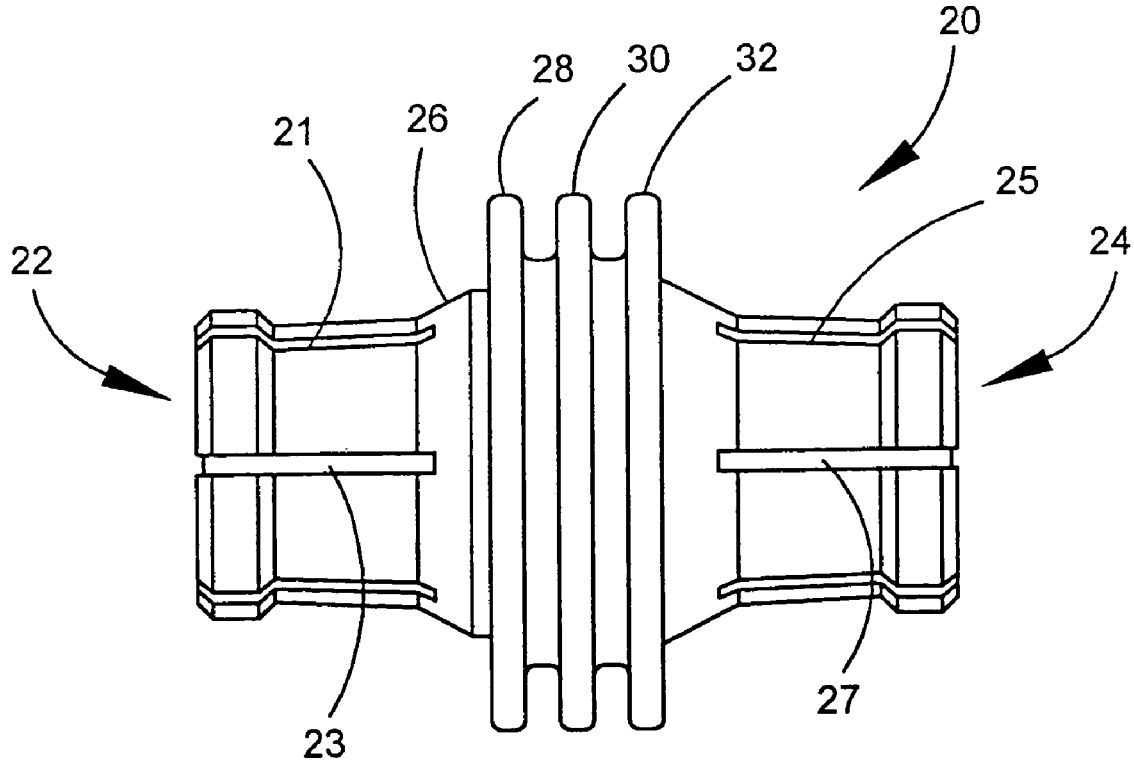
FIG. 2 is a side view of the coaxial connector shown in FIG. 1.

A preferred form of a coaxial connector constructed in accordance with the teachings of the present invention is designated generally in FIGS. 1 and 2 by reference numeral 20. Connector 20 is illustrated in the form of a so-called "blindmate interconnect", or "bullet", having two opposing ends 22 and 24 formed as female ports. Visible within FIGS. 1 and 2 is a generally tubular hollow outer conductor body 26. Slots, like those designated as 21, 23, 25, and 27, are formed in opposing ends 22 and 24 of outer conductor 26 to allow such end regions to flex when being coupled to the outer conductor of a mating coaxial member. Outer conductor 26 includes three cooling fins 28, 30 and 32 to help transfer heat away from outer conductor 26. Cooling fins 28, 30, and 32 are located generally centrally between the first and said second ends 22 and 24 of outer conductor 26. Outer conductor body 26 is preferably made from a beryllium copper alloy (BeCu) covered by nickel plating (1.27 μm (50 microinches) minimum thickness), then covered by gold plating (1.27-2.54 μm (50-100 microinches) thick).

Also visible within FIG. 1 is a first end 34 of a center conductor 46 of connector 20. As shown in FIG. 1, first end 34 of the center conductor 46 is formed as a female socket including a series of slotted fingers which open outwardly to receive a male pin (not shown) of a mating coaxial member. The female socket formed at first end 34 of the center conductor includes at least two and preferably four such slotted fingers 36, 38, 40 and 42. Increasing the number of such slotted fingers which make contact with the male pin reduces the contact resistance between such elements.

Also visible within FIG. 1 is a first end 56 of a dielectric member which electrically insulates the center conductor 46 from the outer conductor 26, in a manner to be described in greater detail below in conjunction with FIGS. 3-6. The female port formed at first end 22 of connector 20 is preferably adapted to mate with either an SMP connector, or an SMPM connector, of the type described in MILSTD 348.

Figure 3:
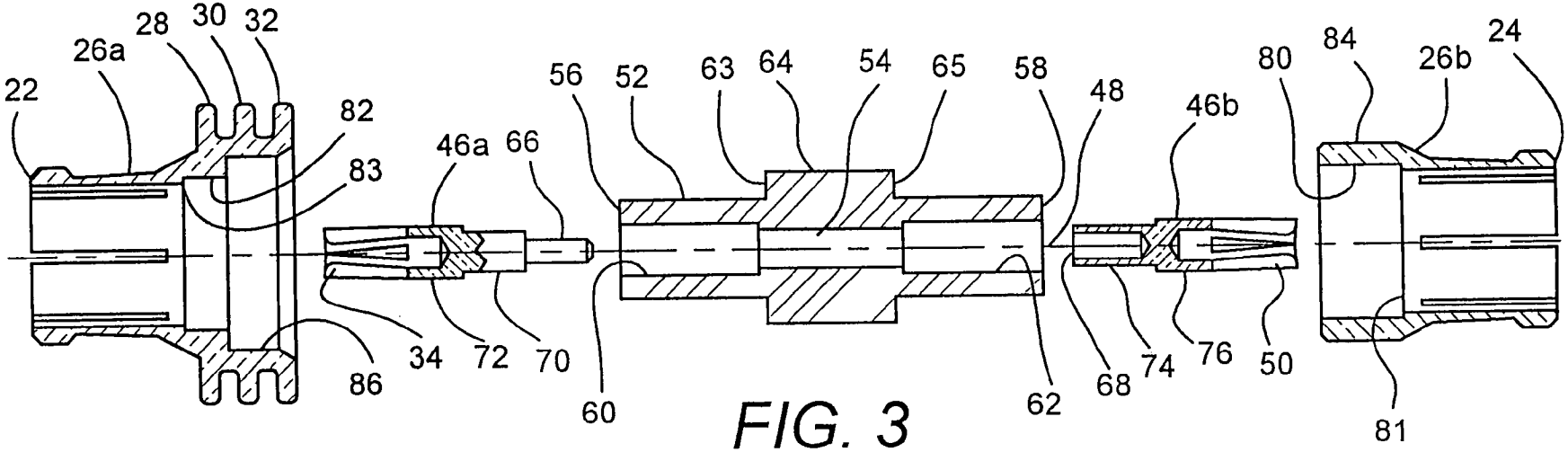
FIG. 3 is an exploded sectional view of the coaxial connector shown in FIGS. 1 and 2, and illustrating five separate components prior to assembly.
Figure 4:
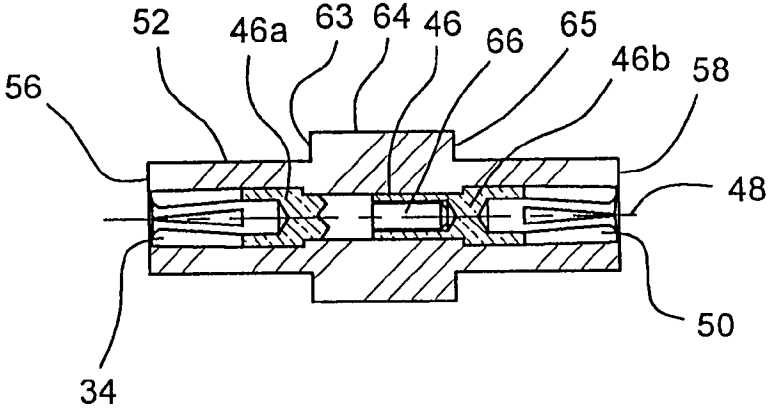
FIG. 4 is a sectional view of the dielectric after first and second halves of the center conductor are coupled together therein.

Turning to FIGS. 3 and 4 of the drawings, a two-piece center conductor 46 is preferably formed from first and second halves 46*a* and 46*b* which extend along the common axis 48 of the connector. Center conductor halves 46*a* and 46*b* are preferably made from a beryllium copper alloy (BeCu) covered by nickel plating (1.27 μm (50 microinches) minimum thickness), then covered by gold plating (1.27-2.54 μm (50-100 microinches) thick). As shown in FIG. 4, first and second halves 46*a* and 46*b* are mechanically and electrically coupled to each other within the central portion of the connector. Center conductor 46 provides first and second opposing ends 34 and 50. Second end 50 includes slotted fingers to form a female socket in the same manner described above for first end 34. The overall length of center conductor 46, when assembled, preferably essentially corresponds with the length of assembled connector 20.

As shown in FIGS. 3 and 4, coaxial connector 20 includes a dielectric member 52. Dielectric member 52 electrically insulates center conductor 46 from outer conductor body 26 and maintains a desired characteristic impedance along the signal transmission path generally parallel to axis 48. Dielectric member 52 also provides physical support for center conductor 46, and maintains center conductor 46 in proper axial alignment with outer conductor body 26.

It will be recalled that one of the objects of the present invention is to extend the power level range of a microwave connector beyond power levels tolerated by such connectors that are currently available. To achieve that objective, it is important to conduct heat away from center conductor 46. As explained above, conventional PTFE is a relatively poor conductor of heat. To achieve the power levels desired, it is necessary to increase the thermal conductivity of the dielectric by at least three times over conventional PTFE to about 0.75 W/(m-° K) (5 BTU-in/(hr.-ft.$^2$-° F.)) or more.

In preferred embodiments, the dielectric member 52 is formed from a reinforced fluoropolymer, such as a material now sold by Saint-Gobain Ceramics & Plastics Inc. of Wayne, N.J. (and formerly sold by the Furon Company) under the brand name Fluoroloy H®, which is a ceramic-filled reinforced fluoropolymer form of PTFE material which has a thermal conductivity that is from approximately five to eight-times that of pure virgin PTFE; accordingly, it is a much better conductor of heat. In addition, the coefficient of thermal expansion for Fluoroloy H® material is only about one-fourth that for virgin PTFE, so increased heating is less likely to alter the physical dimensions of such material compared to conventional PTFE. Fluoroloy H® material can be more difficult to machine and assemble because it is relatively brittle and incompressible when compared with virgin PTFE. However, these difficulties can be overcome by constructing a coaxial connector in the manner described herein.

Dielectric member 52 includes a central axial bore 54 extending therethrough from the first end 56 of dielectric member 52 to its opposing second end 58. Central axial bore 54 includes a central region of a first inner diameter $d_1$. Central axial bore 54 also includes opposing end regions 60 and 62 having a second, somewhat larger inner diameter $d_2$ when compared to the first inner diameter $d_1$ of the central region of dielectric member 52. As apparent from FIGS. 3 and 4, dielectric member 52 has an outer surface, and the central region 64 of dielectric member 52 has an enlarged outer diameter $D_1$ in comparison with the smaller outer diameter regions of outer diameter $D_2$ on either side thereof. The enlarged diameter central region 64 is bordered by opposing side walls 63 and 65.

Still referring to FIG. 3, it will be noted that first half 46*a* of center conductor 46 includes a first female socket corresponding to first end 34 of center conductor 46, as well as a first coupling member in the form of a pin 66. Likewise, second half 46*b* of center conductor 46 includes a second female socket corresponding to second end 50 of center conductor 46, as well as a second coupling member in the form of a socket 68. Socket 68 is adapted to slidingly receive pin 66 during assembly of connector 20 sufficient to mechanically and electrically interconnect the first and second halves 46*a* and 46*b* of center conductor 46.

During assembly of connector 20, first half 46*a* of center conductor 46 is inserted into end region 60 of central bore 54. Pin 66 extends from a shoulder 70 having an outer diameter $D_3$ that is commensurate with the inner diameter $d_2$ of central bore 54 within the central region of dielectric member 52. In turn, shoulder 70 extends from a somewhat larger diameter portion 72 of first half 46*a* having diameter $D_4$; the female socket portion 34 is formed in this larger diameter portion 72. As first half 46*a* is inserted into central bore 54 of dielectric member 52, shoulder 70 fits within central bore 54 to form a close fit therewith, and larger diameter portion 72 slides into end region 60 of central bore 54. It is preferably the case that larger diameter portion 72 forms, at most, a loose fit with the surrounding inner wall of end region 56 to allow for expansion of the slotted fingers at female socket 34 when a male pin is inserted therein; as explained below, the preferred dielectric material is somewhat brittle, and compression of the dielectric material upon insertion of such male pin is best avoided.

After first half 46*a* is seated within central bore 54 in the described manner, second half 46*b* is inserted into the opposite end of central bore 54 in a similar manner. Coupling socket 68 of second half 46*b* is formed within a shoulder region 74 having an outer diameter $D_5$ that is commensurate with the inner diameter $d_2$ of central bore 54 within the central region 64 of dielectric member 52. As second half 46*b* is advanced into central bore 54, socket 68 engages pin 66 of first half 46*a*, while shoulder 74 firmly engages the inner wall of central bore 54 of dielectric member 52. Shoulder 74 extends from a somewhat larger diameter portion 76 of second half 46*b*; the female socket portion 50 is formed from this larger diameter portion 74. As second half 46*b* is inserted into central bore 54 of dielectric member 52, shoulder 74 fits within central bore 54 to form a close fit therewith, and larger diameter portion 76 slides into end region 62 of central bore 54. Larger diameter portion 76 forms, at most, a loose fit with the surrounding inner wall of bore region 62 to allow for expansion of the slotted fingers at female socket 50 when a male pin is inserted therein.

Alternatively, second half 46*b* could be inserted into the central bore 54 first, then first half 46*a* is inserted into the central bore 54. In another alternative, the first half 46*a* and the second half 46*b* are simultaneously inserted into the central bore 54.

The end result of the assembly operations described thus far is shown in FIG. 4. It will be noted that the central region 64 of the inner axial bore 54 of dielectric member 52 is in intimate thermal contact with both shoulder 72 of first half 46*a* and shoulder 74 of second half 46*b*. Heat is preferably capable of being transferred from the center conductor 46 to the central region 64 of dielectric member 52 via at least one thermally conductive path between the dielectric member 52 and the central region 64, as preferably provided by mutual physical contact between the shoulder 72 of first half 46*a* and central region 64, and/or between the shoulder 74 of second half 46*b* and central region 64. In preferred embodiments, the central region 64 of dielectric member 52 and both shoulder 72 of first half 46*a* and shoulder 74 of second half 46*b* are in thermal contact via at least one thermally conductive path provided by mutual physical contact between the central region 64 and the first half 46*a* and via at least one thermally conductive path provided by mutual physical contact between the central region 64 and the second half 46*b*. If desired, thermal grease may be applied between center conductor 46 and dielectric member 52, and/or between dielectric member 52 and outer conductor 26, to facilitate thermal contact therebetween. It will also be noted that dielectric member 52 preferably substantially surrounds the outer surface of center conductor 46.

Figure 5:
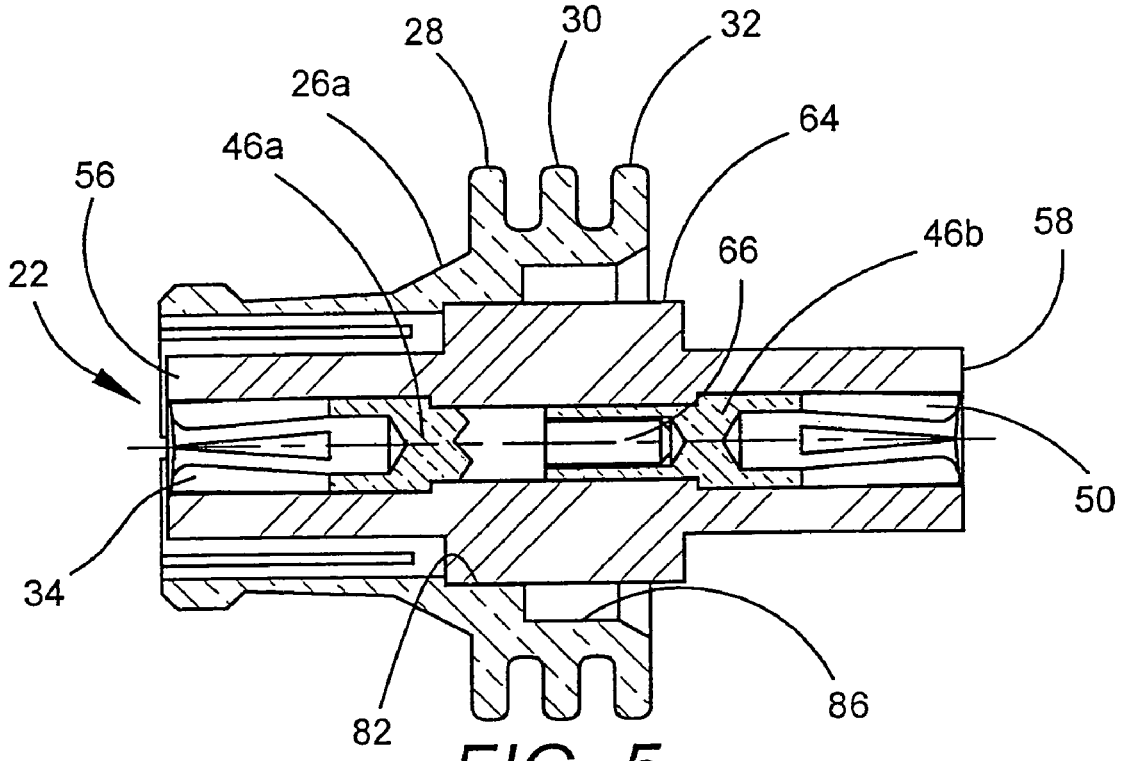
FIG. 5 is a sectional view illustrating insertion of the assembly of FIG. 4 into a first section of the outer conductor.
Figure 6:
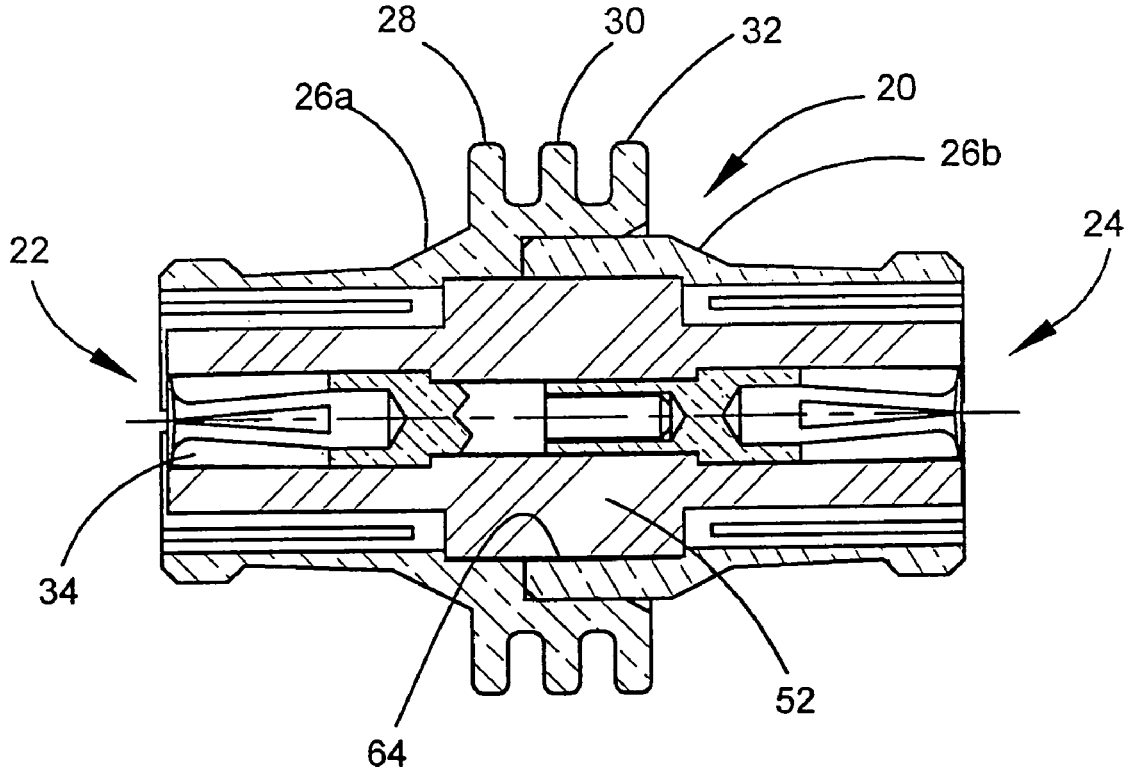
FIG. 6 is a sectional view illustrating the fully-assembled coaxial connector following the addition of the second section of the outer conductor.

Referring to FIG. 3, outer conductor body 26 is split into two sections, 26*a* and 26*b*. Second section 26*b* has an inner wall 80 having a diameter $d_7$ of the same diameter as $D_1$ of the central region 64 of dielectric member 52 in order to engage a portion of central region 64 of dielectric member 52. Inner wall 80 terminates at a reduced diameter step 81. Referring to FIGS. 3 and 6, following final assembly, inner wall 80 does indeed engage a substantial portion of central region 64 of dielectric member 52, and step 81 engages side wall 65. Likewise, first section 26*a* includes an inner wall portion 82 having a diameter $d_8$ of the same diameter as $D_2$ of the central region 64 of dielectric member 52 in order to engage a portion of central region 64 of dielectric member 52. Inner wall portion 82 terminates in a step 83. Referring to FIGS. 2, 5 and 6, following final assembly, inner wall 82 also engages a portion of central region 64 of dielectric member 52, and step 83 engages side wall 63. Collectively, inner walls 80 and 82, and related steps 81 and 83, define an annular recess within outer conductor body 26 which receives and captures the enlarged central diameter region 64 of dielectric member 52, thereby restraining the dielectric 52 from axial movement within outer conductor body 26.

Referring to FIG. 3, the portion of second section 26*b* that lies opposite end 24 has an outer wall 84 with a corresponding outer diameter $D_7$. Upon final assembly, this outer wall 84 is received within first section 26*a* for mating together first and second sections 26*a* and 26*b*. First section 26*a* has a corresponding internal wall 86 having an inner diameter $d_9$ that matches the outer diameter $D_7$ of outer wall 84 of second section 26*b*.

Now turning to FIG. 5, the assembly of FIG. 4 is inserted into first section 26*a* of the outer conductor body 26. The first end 56 of dielectric member 52, and the first female socket 34 of center conductor half 46*a*, both extend preferably essentially flush with the female port end 22 of first section 26*a*. The second section 26*b* is then inserted over the opposing end of the assembly whereby inner wall 80 of second section 26*b* fits over central region 64 of dielectric member 52, while the outer wall 84 of second section 26*b* simultaneously fits within inner wall 86 of first section 26*a*. The second end 58 of dielectric member 52, and the second female socket 50 of center conductor half 46*b*, both extend preferably essentially flush with the female port end 24 of second section 26*b*.

After final assembly, first half 46*a* of the center conductor extends substantially within first section 26*a* of outer conductor 26, and second half 46*b* of center conductor 46 extends substantially within second section 26*b* of outer conductor 26. Outer conductor body 26 substantially surrounds dielectric member 52. The central region 64 of dielectric member 52 is in thermal contact, and in preferred embodiments in direct physical contact, with the central portion of outer conductor 26 (i.e., with inner walls 80 and 82 of sections 26*b* and 26*a*, respectively), proximate to the cooling fins 28, 30 and 32, whereby dielectric member 52 is capable of conveying heat from center conductor 46 outwardly to outer conductor 26 where such heat can be radiated away by cooling fins 28, 30 and 32.

Those skilled in the art will now appreciate that an improved coaxial connector for microwave applications has been described wherein the power level of radio frequency signals that can be reliably passed through such connector can be significantly increased, allowing for greater transmission distances. The overall size of the connector is not significantly increased in comparison with presently available microwave coaxial connectors, so high packing densities are not sacrificed. The described connector can be manufactured and assembled in a simple and reliable manner while reducing the risk of damage to the dielectric member. Nonetheless, the center conductor is reliably captured within the dielectric member, and the dielectric member is securely captured within the outer conductor body.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A method of assembling a coaxial connector used to join two coaxial members, said method comprising the steps of:

a. providing a center conductor comprising first and second mating halves, the first half of the center conductor including a female socket for receiving a male pin of a first mating member, the first half of the center conductor also including a first coupling member opposite the first female socket, and the second half of the center conductor including a female socket for receiving a male pin of a second mating member, the second half of the center conductor also including a second coupling member opposite the second female socket;

b. providing a dielectric with an axial bore extending therethrough between first and second opposing ends;

c. providing a hollow tubular outer conductor, said hollow tubular outer conductor comprising cooling fins to transfer heat away from said outer conductor;

d. inserting the first half of the center conductor within the first end of the axial bore of the dielectric;

e. inserting the second half of the center conductor within the second end of the axial bore of the dielectric, and coupling the first coupling member to the second coupling member such that the first and second halves of the center conductor are coupled together to extend along a common axis; and f. inserting the center conductor and dielectric within the hollow tubular outer conductor, wherein at least a portion of said dielectric physically contacts the outer conductor to provide a thermally conductive path therebetween.

2. The method recited by claim 1 wherein step c. includes providing the hollow tubular outer conductor as first and second mating sections.

3. The method recited by claim 2 wherein step f. includes the steps of:

g. inserting the center conductor, including the dielectric, within the first section of the outer conductor; and h. thereafter engaging the second section of the outer conductor over the assembly formed in step g.

4. The method recited by claim 1 wherein said dielectric is comprised of reinforced fluoropolymer.

5. The method recited by claim 1 wherein the dielectric has a thermal conductivity of 0.75 W/(m-° K) or more.

6. The method recited by claim 1 wherein the center conductor, the dielectric, and the outer conductor share a common longitudinal axis.

7. The method recited by claim 1 wherein thermal grease is disposed between the center conductor and the dielectric member.

8. The method recited by claim 1 wherein thermal grease is disposed between the outer conductor and the dielectric member.

9. The method recited by claim 1 wherein the first and second female sockets each have an outer socket diameter and the first and second coupling members each have an outer diameter, and the outer diameters of the first and second coupling members are each of smaller magnitude than either of the outer socket diameters of the first and second female sockets.

10. The method recited by claim 9 wherein the axial bore of the dielectric has a central region of a first inner diameter proximate at least one of the first and second coupling members for placing the central region of the dielectric in thermal contact with at least one of the first and second coupling members; and wherein the axial bore of the dielectric has first and second opposing end regions, the first and second end regions of the axial bore having a second inner diameter commensurate with the outer socket diameters of the first and second female sockets and of greater magnitude than the first inner diameter of the axial bore.

11. The method recited by claim 1 wherein:

said hollow tubular outer conductor has an inner surface, said inner surface having an annular recess formed therein;

said dielectric has an outer surface that has a central region, the central region of said outer surface of said dielectric including an enlarged outer diameter adapted to extend within the annular recess of said outer conductor; and said annular recess of said outer conductor serving to restrain said dielectric from axial movement within said outer conductor.

* * * * *